US009385419B2

(12) United States Patent
Wong et al.

(10) Patent No.: US 9,385,419 B2
(45) Date of Patent: Jul. 5, 2016

(54) WRIST-WORN COMMUNICATION DEVICE

(71) Applicant: Acer Incorporated, New Taipei (TW)

(72) Inventors: Kin-Lu Wong, New Taipei (TW); Hung-Jen Hsu, New Taipei (TW)

(73) Assignee: Acer Incorporated, New Taipei (TW)

( * ) Notice: Subject to any disclaimer, the term of this patent is extended or adjusted under 35 U.S.C. 154(b) by 268 days.

(21) Appl. No.: 14/060,628

(22) Filed: Oct. 23, 2013

(65) Prior Publication Data

US 2015/0070226 A1 Mar. 12, 2015

(30) Foreign Application Priority Data

Sep. 10, 2013 (TW) ..... 102132605 A

(51) Int. Cl.

| | |
|---|---|
| ***H01Q 1/27*** | (2006.01) |
| ***H01Q 1/48*** | (2006.01) |
| ***H01Q 5/00*** | (2015.01) |
| ***H01Q 5/314*** | (2015.01) |
| *H01Q 9/30* | (2006.01) |

(52) U.S. Cl.

CPC ..... *H01Q 1/273* (2013.01); *H01Q 1/48* (2013.01); *H01Q 5/314* (2015.01); *H01Q 9/30* (2013.01)

(58) Field of Classification Search

CPC ..... H01Q 1/273; H01Q 1/48; H01Q 5/30; H01Q 5/314; H01Q 5/321; H01Q 5/357; H01Q 5/364; H01Q 5/371; H01Q 9/16; H01Q 9/20; H01Q 9/30; H01Q 9/40

See application file for complete search history.

(56) References Cited

U.S. PATENT DOCUMENTS

| | | | | |
|---|---|---|---|---|
| 6,765,846 | B2 * | 7/2004 | Saitou | H01Q 1/08 343/718 |
| 7,903,034 | B2 * | 3/2011 | Anguera | H01Q 1/243 343/700 MS |
| 8,692,728 | B2 * | 4/2014 | Jenwatanavet | H01Q 1/242 343/702 |
| 2010/0214175 | A1 * | 8/2010 | Hui | H01Q 1/243 343/700 MS |
| 2010/0309070 | A1 * | 12/2010 | Wong | H01Q 9/30 343/749 |
| 2013/0169504 | A1 | 7/2013 | Jenwatanavet | |

* cited by examiner

*Primary Examiner* — Sue A Purvis
*Assistant Examiner* — Patrick Holecek
(74) *Attorney, Agent, or Firm* — Jianq Chyun IP Office

(57) ABSTRACT

A communication device, including a device casing, an external connection element, and a first metal element, is provided. A ground element and an antenna element are disposed in the device casing. The ground element has a first edge, a second edge, and a first connection point. The first edge and the second edge are opposite to each other. The first connection point is disposed near or at the second edge. The antenna element is disposed near the first edge. The external connection element is formed by a non-conductive material and is outside the device casing. The external connection element has a belt-like structure and is combined with the device casing to substantially form a loop structure. The first metal element is supported by the external connection element and is coupled to the first connection point of the ground element.

8 Claims, 4 Drawing Sheets

WRIST-WORN COMMUNICATION DEVICE

CROSS-REFERENCE TO RELATED APPLICATION

This application claims the priority benefit of Taiwan application serial no. 102132605, filed on Sep. 10, 2013. The entirety of the above-mentioned patent application is hereby incorporated by reference herein and made a part of this specification.

BACKGROUND OF THE INVENTION

1. Field of the Invention

The invention relates to a communication device and particularly relates to a wrist-worn communication device.

2. Description of Related Art

As the technology of mobile communication advances in the recent years, mobile communication devices are being developed to provide more and diverse functions. Because of the trend of the market and expectation of the consumers, wearable communication devices (e.g. smart watch, smart glasses, etc.) are drawing more and more attention. In particular, the design of a communication device for smart watches needs to have the characteristics of being compact in size and easy to wear. However, such a design may result in an excessively small ground plane and cause that the antenna element of the communication device cannot be operated in a low frequency band of mobile communication (e.g. the frequency band of 900 MHz). Therefore, how to enable an antenna element, applicable to a wrist-worn communication device, to perform multi-band operation to cover the low frequency band has become an important issue.

SUMMARY OF THE INVENTION

The invention provides a communication device, in which a device casing and an external connection element form a loop structure, so that the communication device is applicable to a smart watch. In addition, a metal element is provided outside the device casing, and the metal element is supported by the external connection element and coupled to a ground element in the device casing. Thus, the ground element effectively increases an equivalent resonant length thereof, so as to effectively excite a resonant mode of an antenna element in the device casing and cover multi-band operation of mobile communication (e.g. frequency bands of GSM900/1800/1900).

A communication device of the invention includes a device casing, an external connection element, and a first metal element. A ground element and an antenna element are disposed in the device casing. The ground element has a first edge, a second edge, and a first connection point. The first edge and the second edge are opposite to each other. The first connection point is disposed near or at the second edge. The antenna element is disposed near the first edge. The external connection element is formed by a non-conductive material and is outside the device casing. The external connection element has a belt-like structure and is combined with the device casing to substantially form a loop structure. The first metal element is supported by the external connection element and is coupled to the first connection point.

To make the aforementioned and other features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate exemplary embodiments of the invention and, together with the description, serve to explain the principles of the invention.

DESCRIPTION OF THE EMBODIMENTS

Figure 1A:
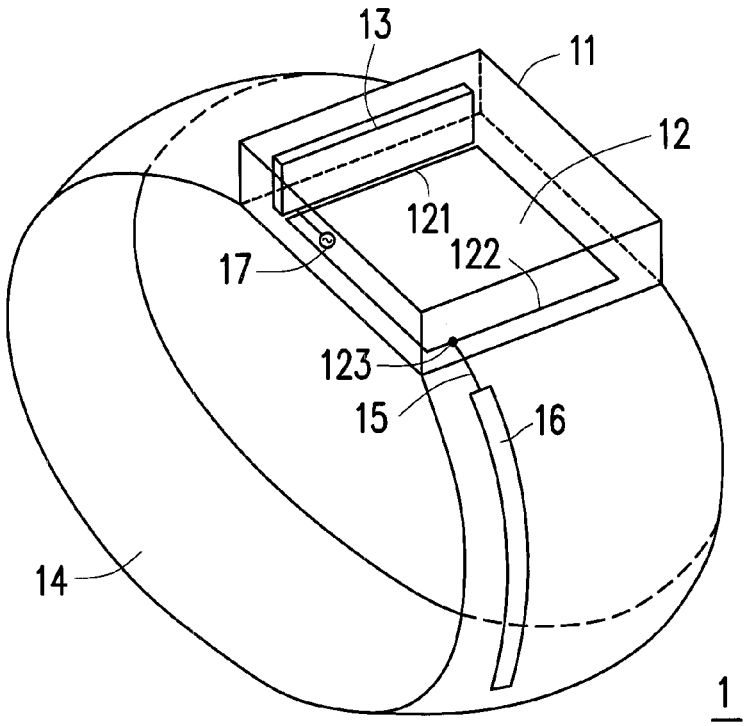
FIG. 1A is a schematic view showing the structure of a communication device according to the first embodiment of the invention.

FIG. 1A is a schematic view showing the structure of a communication device according to the first embodiment of the invention. A communication device 1 includes a device casing 11, an external connection element 14, and a first metal element 16. A ground element 12 and an antenna element 13 are disposed in the device casing 11. The ground element 12 has a first edge 121, a second edge 122, and a first connection point 123. The first edge 121 and the second edge 122 are opposite to each other. The first connection point 123 is disposed near or at the second edge 122. The antenna element 13 is disposed near the first edge 121. In addition, a signal source 17 is coupled to the antenna element 13 for exciting the antenna element 13.

The external connection element 14 is formed using a non-conductive material and is disposed outside the device casing 11. The external connection element 14 has a substantially belt-like structure, and two ends of the belt-like structure are coupled to two opposite sides of the device casing 11 respectively. Accordingly, the external connection element 14 and the device casing 11 substantially form a loop structure. In actual application, with the loop structure, the user may wear the communication device 1 on his/her wrist to carry around and use the communication device 1 easily. In other words, the communication device 1 is a wrist-worn communication device, for example, which is applicable to a smart watch.

The first metal element 16 is disposed outside the device casing 11 and supported by the external connection element 14. For example, the first metal element 16 can be embedded in the external connection element 14 and includes at least a metal wire or a metal sheet. Moreover, the first metal element 16 is coupled to the first connection point 123 of the ground element 12 via a first connection wire 15, and a length of the first metal element 16 is at least 0.3 times a length of the ground element 12.

Thus, the first metal element 16 can be used to adjust an equivalent resonant length of the ground element 12. For instance, the equivalent resonant length of the ground element 12 can be increased by the first metal element 16, so as to properly excite a resonant mode of the antenna element 13 or improve an impedance matching and a radiation efficiency of the antenna element 13 operated in a frequency band. Furthermore, because the first metal element 16 can be covered by the external connection element 14 formed by the non-conductive material, the first metal element 16 is not in direct contact with the user in actual application. Thus, the adjustment of the equivalent resonant length of the ground element 12, made by the first metal element 16, is not affected by the user.

Figure 1B:
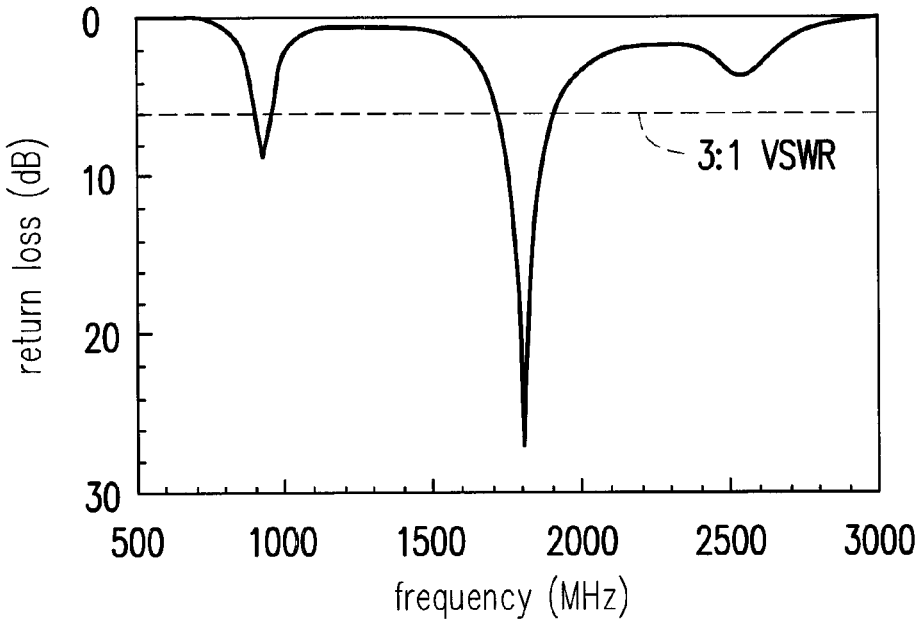
FIG. 1B is a diagram showing a return loss of an antenna element according to the first embodiment of the invention.

FIG. 1B is a diagram showing a return loss of the antenna element according to the first embodiment of the invention. In this embodiment, a size of the ground element 12 is about 45×40 $mm^2$. A length and a height of the antenna element 13 are about 30 mm and 10 mm respectively, and the antenna element 13 is formed on an FR4 substrate. Moreover, in this embodiment, an operation bandwidth of the antenna element 13 is defined by a return loss of 6 dB, that is, a voltage standing wave ratio (VSWR) of 3:1. As shown in FIG. 1B, with the arrangement of the first metal element 16, the frequency band in which the antenna element 13 is operated covers the frequency band of GSM1800.

Figure 2:
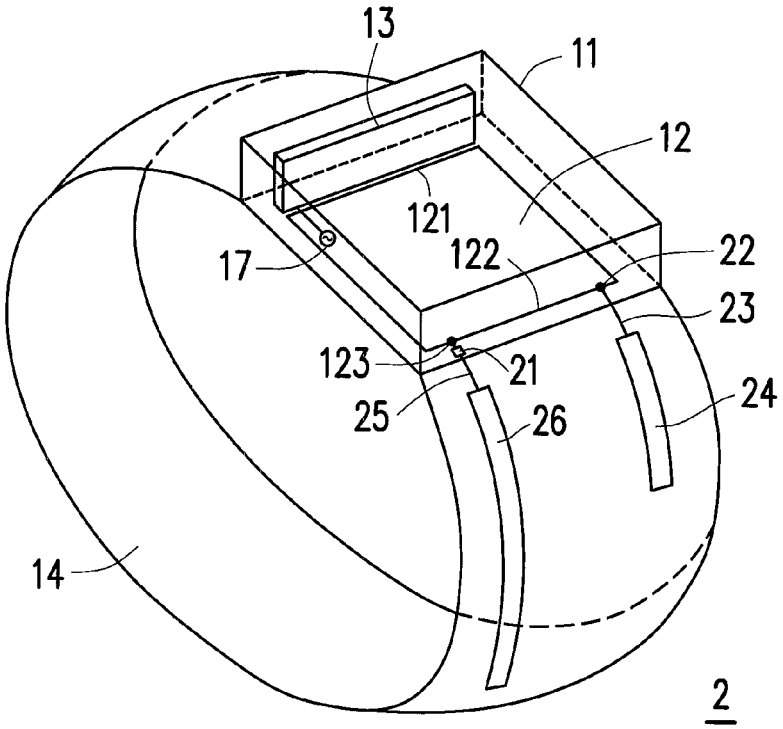
FIG. 2 is a schematic view showing the structure of a communication device according to the second embodiment of the invention.

FIG. 2 is a schematic view showing the structure of a communication device according to the second embodiment of the invention. Basically, a communication device 2 of the second embodiment is similar to the communication device 1 of the first embodiment. The main difference between the second embodiment and the first embodiment is that the communication device 2 further includes an inductive element 21 and a second metal element 24, and the ground element 12 further includes a second connection point 22 disposed near or at the second edge 122.

More specifically, a first metal element 26 is coupled to the first connection point 123 via a first connection wire 25 and the inductive element 21. The second metal element 24 is disposed outside the device casing 11 and supported by the external connection element 14. For example, the second metal element 24 can be embedded in the external connection element 14. Moreover, the second metal element 24 is coupled to the second connection point 22 of the ground element 12 via a second connection wire 23, and a length of the second metal element 24 is at least 0.2 times the length of the ground element 12.

Thus, the equivalent resonant length of the ground element 12 in different frequency bands can be adjusted respectively by the first metal element 26 and the second metal element 24 to improve the impedance matching and radiation efficiency of the antenna element 13 in different frequency bands, so that the antenna element 13 has the characteristic of multi-band operation. For example, the first metal element 26 can be used to adjust the equivalent resonant, length of the ground element 12 in a low frequency band, and the second metal element 24 can be used to adjust the equivalent resonant length of the ground element 12 in a high frequency band. Accordingly, the antenna element 13 can have better impedance matching in both the low frequency and high frequency resonant modes.

Further to the above, because the first metal element 26 is coupled to the first connection point 123 via the inductive element 21, the first metal element 26 can improve the impedance matching of the antenna element 13 in the low frequency resonant mode without affecting the impedance matching of the antenna element 13 in the high frequency resonant mode. Besides, the first metal element 26 and the second metal element 24 can be covered by the external connection element 14 formed by the non-conductive material. Therefore, the first metal element 26 and the second metal element 24 are not in direct contact with the user in actual application. Thus, the adjustments of the equivalent resonant length of the ground element 12, made by the first metal element 26 and the second metal element 24, are not affected by the user. Other parts of the structure of the communication device 2 are identical or similar to those of the first embodiment and thus will not be repeated hereinafter.

Figure 3:
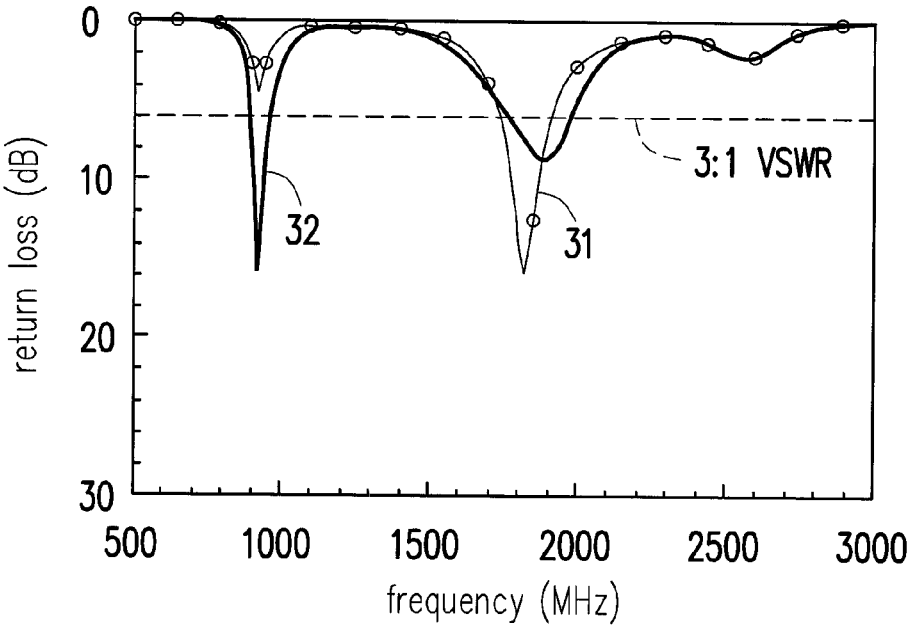
FIG. 3 is a diagram showing a return loss of an antenna element according to the second embodiment of the invention.

FIG. 3 is a diagram showing a return loss of the antenna element according to the second embodiment of the invention. In this embodiment, a length of the first metal element 26 is about 35 mm. An inductance value of the inductive element 21 is about 20 nH. A length of the second metal element 24 is about 18 mm. A length of the loop structure, formed by the external connection element 14 and the device casing 11, is about 230 mm. In addition, a return loss curve 31 indicates a return loss when the first metal element 26 and the second metal element 24 are not added. A return loss curve 32 indicates a return loss when the first metal element 26 and the second metal element 24 are added.

As shown by the return loss curve 31, in the situation that the first metal element 26 and the second metal element 24 are not added, the antenna element 13 only covers the frequency band of GSM1800 (about 1710-1880 MHz). That is to say, the antenna element 13 only has the characteristic of operating in one single frequency band. On the other hand, as shown by the return loss curve 32, in the situation that the first metal element 26 and the second metal element 24 are added, the antenna element 13 can not only be operated in a low frequency band to cover the frequency band of GSM900 (about 880-960 MHz) but also operated in a high frequency band to cover the frequency band of GSM1800/1900 (about 1710-1990 MHz). In other words, with addition of the first metal element 26 and the second metal element 24, the antenna element 13 has the characteristic of operating in multiple frequencies.

Figure 4:
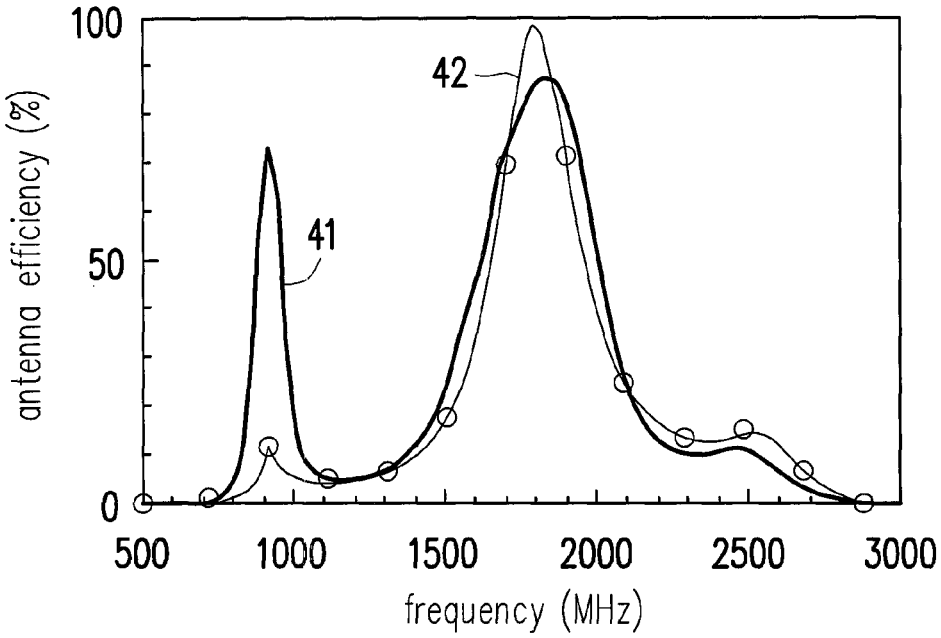
FIG. 4 is a diagram showing an antenna efficiency of the antenna element according to the second embodiment of the invention.

FIG. 4 is a diagram showing an antenna efficiency of the antenna element according to the second embodiment of the invention. Specifically, an antenna efficiency curve 42 indicates an antenna efficiency (the radiation efficiency including the return loss) when the first metal element 26 and the second metal element 24 are not added. An antenna efficiency curve 41 indicates an antenna efficiency (the radiation efficiency including the return loss) when the first metal element 26 and the second metal element 24 are added. It is clearly known from FIG. 4 that, with addition of the first metal element 26 and the second metal element 24, the antenna efficiency of the antenna element 13 can be improved from the antenna efficiency curve 42 to the antenna efficiency curve 41. As a result, the antenna efficiency of the antenna element 13 reaches 51% to 71% in the frequency band of GSM900 and reaches 59% to 87% in the frequency band of GSM1800/1900, and thus the communication device is suitable for multi-band operation of mobile communication.

Figure 5:
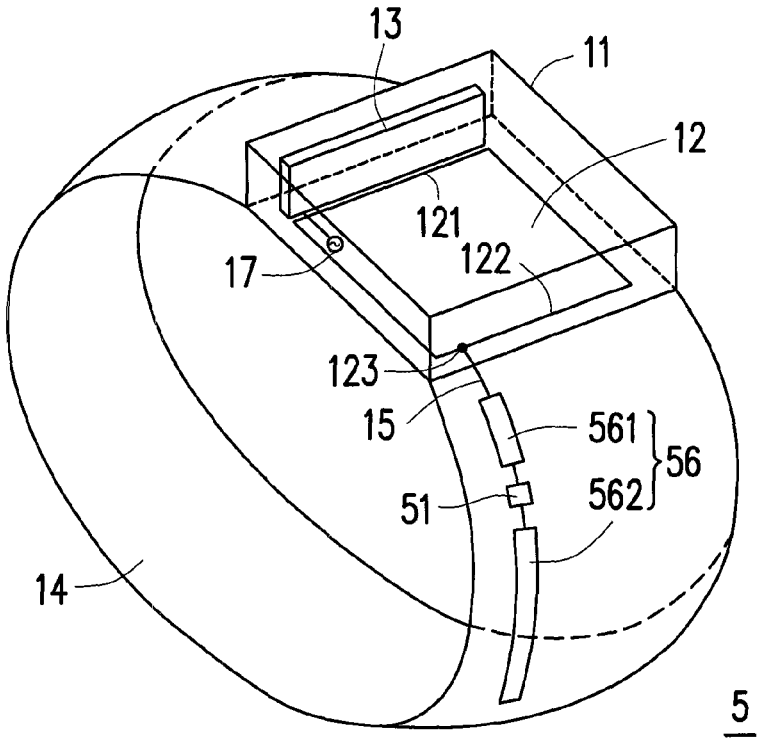
FIG. 5 is a schematic view showing the structure of a communication device according to the third embodiment of the invention.

FIG. 5 is a schematic view showing the structure of a communication device according to the third embodiment of the invention. Basically, a communication device 5 of the third embodiment is similar to the communication device 1 of the first embodiment. The main difference between the third embodiment and the first embodiment is that the first metal element 56 includes a first portion 561 and a second portion 562, and an inductive element 51 is inserted between the first portion 561 and the second portion 562. More specifically, the first portion 561 is coupled to the first connection point 123, and the first portion 561 is coupled to the second portion 562 via the inductive element 51. In other words, it can be regarded that the inductive element 51 separates the first metal element 56 into the first portion 561 and the second portion 562. Moreover, a length of the first portion 561 is at least 0.2 times a length of the second portion 562.

It should be noted that the first portion 561 can be used to adjust the impedance matching and radiation efficiency of the antenna element 13 in a high frequency band. In addition, because the inductive element 51 is inserted between the first portion 561 and the second portion 562, the first metal element 56 can also be used to adjust the impedance matching and radiation efficiency of the antenna element 13 in a low frequency band. That is, the first metal element 56 can improve the impedance matching and radiation efficiency of the antenna element 13 in two different frequency bands to achieve effects similar to the second embodiment. Other parts of the structure of the communication device 5 are identical or similar to those of the first embodiment and thus will not be repeated hereinafter.

Figure 6:
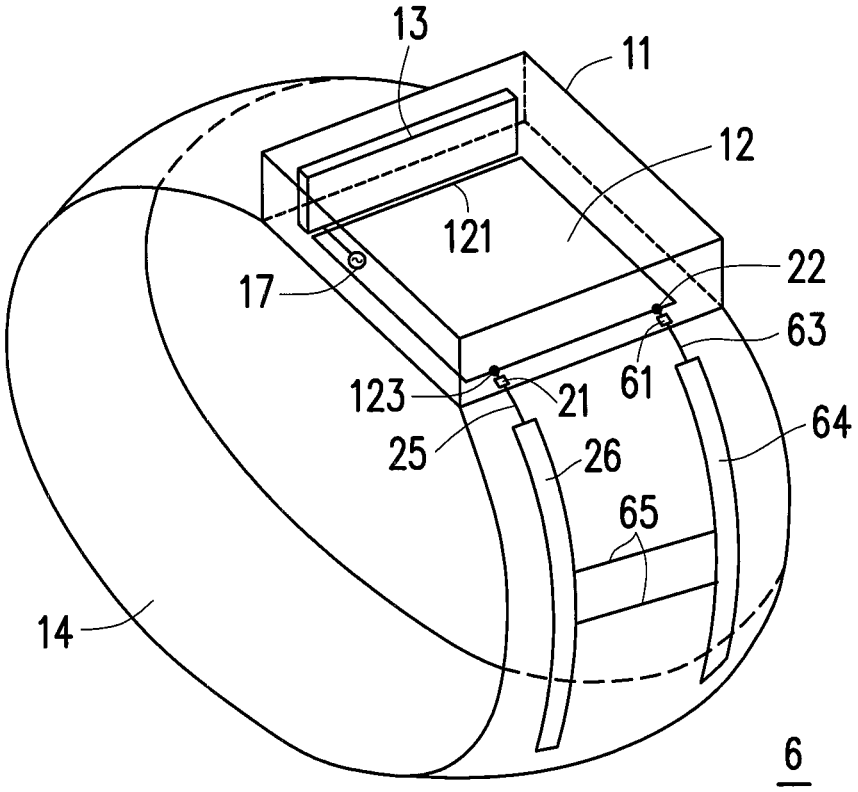
FIG. 6 is a schematic view showing the structure of a communication device according to the fourth embodiment of the invention.

FIG. 6 is a schematic view showing the structure of a communication device according to the fourth embodiment of the invention. Basically, a communication device 6 of the fourth embodiment is similar to the communication device 2 of the second embodiment. The main difference between the fourth embodiment and the second embodiment is that a second metal element 64 is coupled to the second connection point 22 via a second connection wire 63 and an inductive element 61, and the communication device 6 further includes at least one connection wire 65.

More specifically, the second metal element 64 and the first metal element 26 are electrically connected by the at least one connection wire 65. Accordingly, the second metal element 64 and the first metal element 26 are equivalent to a larger metal sheet for further improving the impedance matching of the antenna element 13 in a resonant mode. Moreover, the second metal element 64 is coupled to the second connection point 22 via the inductive element 61. Thus, the flexibility of using the second metal element 64 to adjust the equivalent resonant length of the ground element 12 is increased. Due to the similar structures, the communication device 6 of the fourth embodiment achieves effects similar to the second embodiment. Other parts of the structure of the communication device 6 are identical or similar to those of the second embodiment and thus will not be repeated hereinafter.

It will be apparent to those skilled in the art that various modifications and variations can be made to the disclosed embodiments without departing from the scope or spirit of the invention. In view of the foregoing, it is intended that the invention covers modifications and variations of this disclosure provided that they fall within the scope of the following claims and their equivalents.

What is claimed is:

1. A communication device, comprising:

a device casing, wherein a ground element and an antenna element are disposed in the device casing, the ground element comprises a first edge, a second edge opposite to the first edge, and a first connection point, the first connection point is disposed near or at the second edge, and the antenna element is disposed near the first edge;

an external connection element formed by a non-conductive material and disposed outside the device casing, wherein the external connection element has a belt-like structure and is combined with the device casing to substantially form a loop structure;

a first metal element supported by the external connection element, wherein a first end of the first metal element is coupled to the first connection point;

a second metal element supported by the external connection element, wherein a first end of the second metal element is coupled to a second connection point of the ground element, second ends of the first metal element and the second metal element are open ends, and the second connection point is disposed near or at the second edge; and at least one connection wire supported by the external connection element and disposed between the first metal element and the second metal element, wherein the second metal element is electrically connected to the first metal element via the at least one connection wire.

2. The communication device according to claim 1, wherein the first metal element is coupled to the first connection point via an inductive element.

3. The communication device according to claim 1, wherein the first metal element is embedded in the external connection element and includes at least a metal wire or a metal sheet.

4. The communication device according to claim 1, wherein a length of the first metal element is 0.3 to 0.8 times a length of the ground element.

5. The communication device according to claim 1, wherein the first metal element comprises a first portion and a second portion, the first portion is coupled to the first connection point and coupled to the second portion via an inductive element, and a length of the first portion is at least 0.2 times a length of the second portion.

6. The communication device according to claim 1, wherein the second metal element is coupled to the second connection point via an inductive element.

7. The communication device according to claim 1, wherein the second metal element is embedded in the external connection element.

8. The communication device according to claim 1, wherein a length of the second metal element is 0.2 to 0.4 times a length of the ground element.

* * * * *